United States Patent [19]

Ceccacci

[11] 4,383,429

[45] May 17, 1983

[54] APPARATUS FOR FORMING A POINT AT THE END OF A METAL TUBE BY MEANS OF A DRAWING OPERATION

[75] Inventor: Bruno Ceccacci, Florence, Italy

[73] Assignee: La Metalli Industriale S.p.A., Borgo Pinti, Italy

[21] Appl. No.: 241,581

[22] Filed: Mar. 9, 1981

[30] Foreign Application Priority Data

Apr. 16, 1980 [IT] Italy ..... 67594 A/80

[51] Int. Cl.[3] ..... B21D 41/04

[52] U.S. Cl. ..... 72/318; 72/75; 72/467

[58] Field of Search ..... 72/75, 206, 316, 318, 72/343, 352, 467; 228/60

[56] References Cited

U.S. PATENT DOCUMENTS 1,919,869 7/1933 Stanitz et al. ..... 72/75

FOREIGN PATENT DOCUMENTS 1452334 12/1968 Fed. Rep. of Germany ..... 72/467

507567 12/1954 Italy ..... 72/75

*Primary Examiner*—Lowell A. Larson

*Attorney, Agent, or Firm*—Gifford, VanOphem, Sheridan & Sprinkle

[57] ABSTRACT

The apparatus of the invention is characterized by comprising a die through which the end of the tube is passed in order to form the point, and which is provided with a first substantially cylindrical bore of diameter less than the diameter of said tube, a substantially conical second bore coaxial with the preceding and of which the minimum diameter is equal to the diameter of said first bore and the maximum diameter is greater than the diameter of the tube, and at least three revolving bodies disposed in corresponding seats of said die, each of which projects radially to a predetermined extent from the surface of said second bore towards the axis of the bore itself, and drive means arranged to axially move said die relative to said tube in order to bring the end of the tube inside said first and second bore and into cooperation with said revolving bodies.

17 Claims, 6 Drawing Figures

APPARATUS FOR FORMING A POINT AT THE END OF A METAL TUBE BY MEANS OF A DRAWING OPERATION

BACKGROUND OF THE INVENTION

This invention relates to an apparatus with which, by means of a drawing operation, as end portion is formed on a metal tube of given diameter which has a diameter less than said given diameter.

In carrying out normal drawing operations on a metal tube in order to obtain therefrom a tube of smaller diameter, it must be provided with an end portion having a diameter substantially less than that of said tube, the purpose of which is to enable the tube to be easily inserted into the dies in the actual drawing apparatus, and to cooperate with parts of suitable means for feeding the tube through the die.

Said tubes are prepared for such drawing operations by a pointing machine, with which the end of each tube is given an actual point which comprises a substantially cylindrical end portion connected to the tube by another substantially conical portion.

Said apparatus comprises a die through which the end of said tube is passed and which has a minimum diameter less than the tube diameter and substantially equal to the diameter of the end portion of the point to be obtained.

In such apparatus, the tube is usually held fixed relative to the apparatus frame by means of suitable jaws operated by a first hydraulic cylinder while the die is moved axially relative to the tube. This die is usually carried by a slide mobile on suitable columns in the apparatus by the action of a second hydraulic cylinder. Apparatus of the aforesaid type present certain drawbacks.

Firstly, the force necessary in order to form said point on the end portion of the tube by means of permanently deforming the tube material is very large because of the very high radial pressures which the die surfaces have to apply to the tube surface under formation in order to reduce its relative diameter to the extent necessary for forming said point. These pressures are high both because of the large ratio of the initial tube diameter to the final point diameter, and because of the considerable mechanical strength of the material, due to the fact that said tubes are constructed of unannealed metal, and thus have a very high hardness and ultimate tensile stress.

Because considerable forces are necessary for carrying out the described forming operation, the relative apparatus must be of large overall dimensions. In this respect, the closure force of said jaws which retain the tube during the operation is proportional to the drawing force, as the connection between the tube and jaws is provided only by the friction force generated between the contacting surfaces thereof. Because of the high drawing force and low coefficient of friction (in this case of the order of 0.10), the closure force of the jaws must be very large, with the consequence that these jaws and the relative hydraulic cylinder must be of considerable size. The die support slide and its operating cylinder, which must be able to generate said drawing force, must also obviously be very large.

Finally, the point obtained by the described apparatus is not always completely uniform because of undesirable movements of the material of said point, and sometimes it does not have sufficient mechanical strength to enable it to be used for the purposes for which said point is intended.

SUMMARY OF THE INVENTION

The object of the present invention is to provide an apparatus for forming, on a tube of predetermined diameter, an end portion having a diameter less than said diameter, the apparatus being free from the aforesaid drawbacks and in particular requiring only a low operating force such as to lead to very small dimensions and overall sizes of the various parts of the apparatus.

A further object of the invention is to provide an apparatus of the aforesaid type with which it is possible to form end portions having a substantially uniform shape and dimensions and which is of very high mechanical strength.

The apparatus of the invention is characterized by comprising a die through which said end of the tube is passed in order to form said portion, and which is provided with a substantially cylindrical first bore of diameter less than the diameter of said tube, a substantially conical second bore coaxial to the preceding and of which the minimum diameter is equal to the diameter of said first bore and the maximum diameter is greater than said diameter of the tube, and at least three revolving bodies disposed in corresponding seats of said die, each of which projects radially to a predetermined extent from the surface of said second bore towards the axis of the bore itself, and drive means arranged to axially move said die relative to said tube in order to bring said end of the tube inside said first and second bore and into cooperation with said revolving bodies.

BRIEF DESCRIPTION OF THE DRAWINGS

The apparatus of the present invention will be more apparent from the description given hereinafter of one embodiment thereof with reference to the accompanying drawings in which.

DETAILED DESCRIPTION OF THE INVENTION

Figure 1:
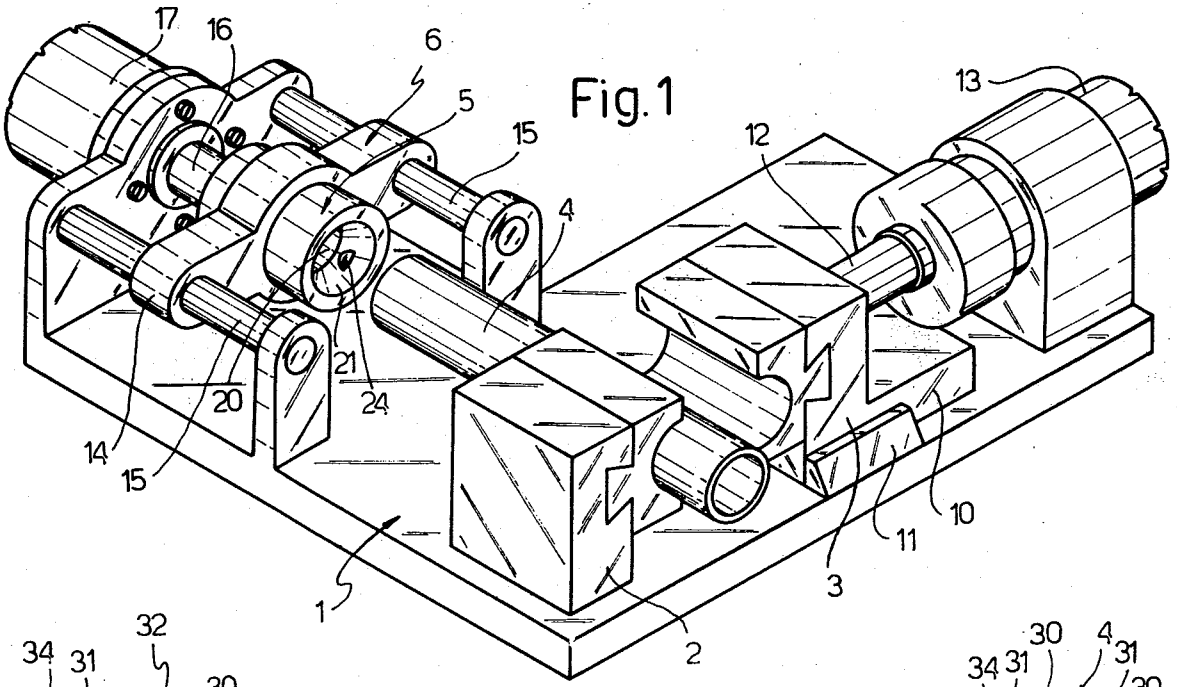
FIG. 1 is a diagrammatic perspective view of the apparatus according to the invention.

The apparatus according to the invention, shown in FIG. 1, comprises substantially a frame 1 provided with a pair of jaws 2 and 3, arranged to lock therebetween a tube 4 (the end of which is to be provided with a portion of reduced diameter), a die 5 for carrying out a drawing operation on said end, and means for driving the die indicated overall by 6. Conveniently, whereas the jaw 2 is fixed to the frame 1, the jaw 3 is mobile and arranged to be moved towards and away from the other. For this purpose, it is rigid with a slide 10 mobile on suitable guides 11 of the frame 1. Said slide 10 is rigid with the rod 12 of a first hydraulic cylinder 13 which controls its movement.

The drive means 6 for the die 5 conveniently comprise a slide 14 on which the die 5 is fixed and is mobile on a pair of columns 15. Said slide 10 is rigid with the rod 16 of a second hydraulic cylinder 17, for controlling the axial movement of said slide 10.

Figure 2:
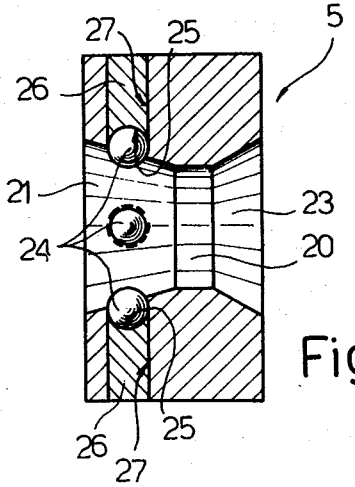

The die 5, shown in section in FIG. 2, comprises substantially a first substantially cylindrical axial bore 20, the diameter of which is less than the diameter of the tube 4 on which the point is to be formed, and a second substantially conical bore 21 coaxial to the preceding. Its smaller diameter is substantially equal to the diameter of the bore 20, while its greater diameter is greater than the diameter of said tube 4. Conveniently, said die comprises a third bore 23 coaxial to the preceding bores, and also conical but with its conicity in the opposite direction to that of the bore 21.

The die 5 is provided with at least three revolving bodies 24, which in the embodiment illustrated are balls, each of which projects to a slight degree radially towards the axis of the die 5 from the conical surface of the second bore 21, as can be seen in FIG. 2. Although in the embodiment illustrated the revolving bodies 24 are balls, it is apparent that they can have any other form, and can, for example, be rollers, in particular barrel shaped rollers.

The revolving bodies 24 are housed in corresponding seats 25 provided in the zone containing the conical bore 21, and are free to rotate in their seats 25 about any axis while sliding, during this rotation, on the contacting surfaces of said seats 25. In the case of the embodiment illustrated, the seat 25 for each ball 24 is provided by forming a radial bore 27 in the die 5, this bore comprising a first substantially cylindrical portion having a diameter greater than the ball diameter, and a second substantially conical end portion, the minimum diameter of which is less than the ball diameter, so as to retain it, with the cooperation of the plug 26, inside the relative seat 25. This latter is, therefore, defined by part of the surface of the second end portion of the bore 27 and by the lower surface of said plug 26.

The operation of the described apparatus is as follows.

The end of the tube 4 is locked between the jaws 2 and 3 by operating the relative hydraulic cylinder 13 so as to move the mobile jaw 3 against the tube 4 and lock this latter between the jaws 2 and 3. The hydraulic cylinder 17 is then operated in order to move the slide 14 towards the end of the tube 4 and cause the die 5 to cooperate with said end.

Figure 4:
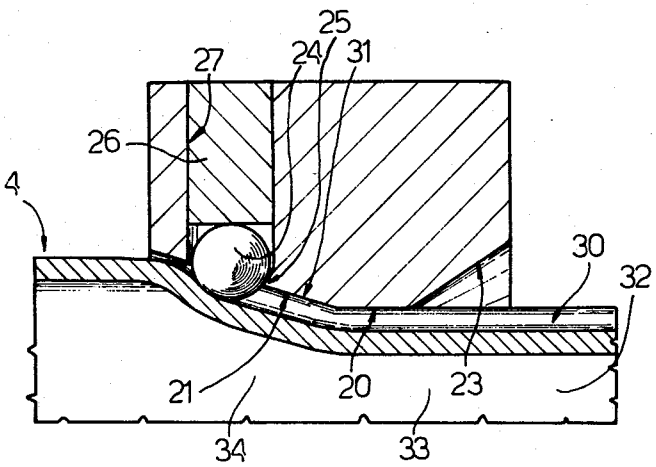
FIG. 4 is a longitudinal section through the die of FIG. 2 while a tube end portion formed by the apparatus is passing through it.

As the die 5 is fed relative to the tube, the tube end is subjected to an actual reverse drawing operation. In this respect, the tube end initially enters the first bore portion 21 (FIGS. 2 and 4), and is thrust inside it until its outer surface comes into cooperation with the surface of the balls 24. As the movement of the die 5 relative to the tube 4 proceeds, said balls 24 generate very high local pressures on the surface of the tube end which tend to deform the contact zones, to form actual grooves 30 (FIG. 4). Consequently that part of the tube which forms downstream of that section of the die containing the balls 24 comprises a plurality of longitudinal grooves 30, and the surface 31 of this part cooperates with the surface of the first bore 21, the diameter of which reduces gradually. As the die feed continues, the tube being shaped enters the first cylindrical bore 20 to undergo a further diameter reduction, until it emerges from it.

Figure 6:
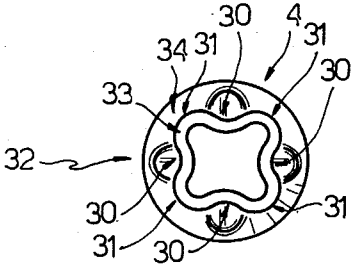
FIGS. 5 and 6 are two orthogonal views of the tube end portion formed by the apparatus according to the invention.
Figure 5:
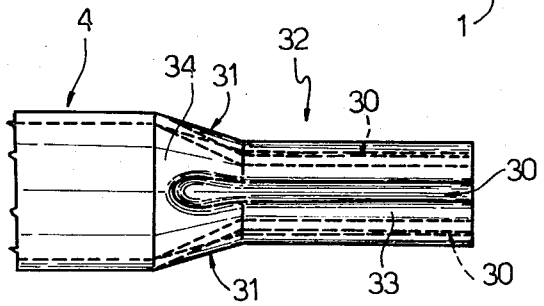
Figure 3:
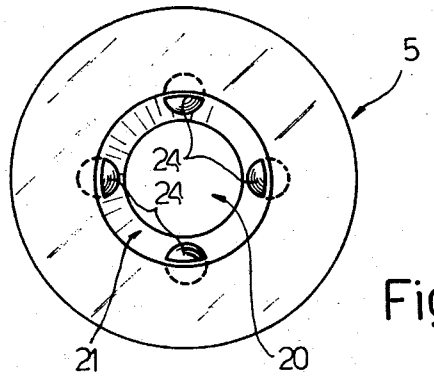
FIGS. 2 and 3 are a longitudinal section and a side view of the die of the apparatus according to the invention, respectively.

The end portion 32 which thus forms, and which is visible in the side and front view respectively in FIGS. 5 and 6, comprises substantially a first substantially cylindrical part 33 provided with a plurality of longitudinal grooves 30, and a second substantially conical part 34 from which said grooves originate. The outer sections of the first part of the end portion 32 are substantially constant and can be perfectly inscribed in a circle. Furthermore, the end portions thus formed are all substantially equal and free from defects. The mechanical strength thereof is also very high, and the presence of the longitudinal grooves 30 probably contributes to the strength increase.

The force with which the slide 14 has to be moved in order to form the end portion 32 is very low and much less than that required in previous methods. It has been found that in some cases this force is of the order of one half of that necessary in the methods heretofore described.

This favourable result is due to the action of the balls 24, which constitute an intermediate means between the tube 4 and die 5 surface, so considerably reducing the overall friction during their relative movement and forming the axial grooves 30, to allow easy reduction of the tube cross-section under formation by small radial pressures which are much less than those normally necessary if said grooves are absent.

It is apparent that modifications can be made to the various parts of the apparatus of the described embodiment of the present invention without leaving the scope of the inventive idea.

What we claim is:

1. An apparatus for forming, on a metal tube of predetermined diameter, an end portion having a diameter less than said predetermined diameter, characterized by comprising a die through which said end of the tube is passed in order to form said portion, and which is provided with a first substantially cylindrical bore of diameter less than the diameter of said tube, a second substantially conical bore coaxial to the preceding and of which the minimum diameter is equal to the diameter of said first bore and the maximum diameter is greater than said diameter of the tube, and at least three revolving bodies disposed in corresponding seats of said die provided in the zone comprising said second bore, each of said bodies projecting radially to a predetermined extent from the surface of said second bore towards the axis of the bore itself, and drive means arranged to axially move said die relative to said tube in order to bring said end of the tube inside said first and second bore and into cooperation with said revolving bodies.

2. An apparatus as claimed in claim 1, characterized in that said revolving bodies are balls.

3. An apparatus as claimed in claim 1, characterized in that said revolving bodies are rollers.

4. An apparatus as claimed in claim 1, characterized in that said drive means comprise at least one jaw arranged to lock said tube, and a mobile slide arranged to support said die.

5. An apparatus as claimed in claim 4, characterized in that the opening and closing of said jaw are controlled at least by a first hydraulic cylinder, and the movement of said slide is controlled by a second hydraulic cylinder.

6. An apparatus as claimed in claim 1, characterized in that said die comprises a plurality of radial perforations, in each of which a corresponding closure plug is inserted, each of said seats for the revolving bodies being defined by part of the surface of one of said perforations and by a surface of the relative plug.

7. An apparatus as claimed in claim 6 in which said revolving bodies are balls, characterized in that each of said perforations is a bore comprising a cylindrical portion of diameter greater than the diameter of the relative ball, and an end portion having its minimum diameter less than the diameter of the ball.

8. An apparatus for forming a tubular end portion on a tube of a given diameter wherein said end portion has a diameter less than said given diameter; said apparatus comprising a die, and means for axially driving said die and said tube relative to one another in order to engage said end of said tube with said die; said die comprising:

a substantially cylindrical bore, said bore having an internal diameter substantially equal to the diameter of said end portion;

a substantially conical bore adjacent to and coaxial with said cylindrical bore; and at least three revolving bodies on said conical bore projecting radially towards the axis of said die;

said internal diameter being sufficiently large to maintain an open cross-section in said tubular end portion when said die and said tube are driven relative to one another.

9. The apparatus according to claim 8, wherein said revolving bodies project only a slight degree radially towards the axis of said die.

10. The apparatus according to claim 8, wherein the distance from each of said revolving bodies to the axis of said die is greater than the radius of said cylindrical bore.

11. The apparatus according to claim 8, wherein said at least three revolving bodies are disposed in a corresponding number of seats in the wall of said conical bore.

12. The apparatus according to claim 8, wherein each of said revolving bodies comprises a ball.

13. The apparatus according to claim 8, wherein each of said revolving bodies comprises a roller.

14. The apparatus according to claim 8, wherein said drive means comprises a locking jaw engageable with said tube, and a movable slide supporting said die.

15. The apparatus according to claim 14, wherein said jaw and said slide are hydraulically activated.

16. The apparatus according to claim 11, wherein a multiplicity of recesses are disposed through the wall of said conical bore, equal in number to the number of said revolving bodies; and wherein a closure plug having a body-engaging surface is inserted into each of said recesses, each of said seats thereby comprising a portion of the surface of the corresponding recess and the body-engaging surface of the corresponding plug.

17. The apparatus according to claim 16, wherein each of said revolving bodies comprises a ball; and further wherein each of said recesses comprises a bore having at least a first substantially cylindrical portion with a diameter greater than the diameter of the corresponding ball, and a second-ball retaining portion having a minimum diameter less than the diameter of the corresponding ball.

* * * * *